US009238232B2

(12) United States Patent
Maxwell

(10) Patent No.: US 9,238,232 B2
(45) Date of Patent: Jan. 19, 2016

(54) CONTINUOUS LOADING AND UNLOADING CENTRIFUGE

(76) Inventor: James F. Maxwell, Provo, UT (US)

( * ) Notice: Subject to any disclaimer, the term of this patent is extended or adjusted under 35 U.S.C. 154(b) by 1079 days.

(21) Appl. No.: 13/189,537

(22) Filed: Jul. 24, 2011

(65) Prior Publication Data

US 2012/0061296 A1 Mar. 15, 2012

Related U.S. Application Data

(62) Division of application No. 11/946,043, filed on Nov. 27, 2007, now Pat. No. 7,985,171.

(60) Provisional application No. 60/867,354, filed on Nov. 27, 2006.

(51) Int. Cl.
*B04B 1/20* (2006.01)
*B04B 3/04* (2006.01)
*B04B 11/08* (2006.01)

(52) U.S. Cl.
CPC ... *B04B 1/20* (2013.01); *B04B 3/04* (2013.01); *B04B 11/082* (2013.01); *B04B 2001/2083* (2013.01)

(58) Field of Classification Search
CPC ..... B04B 1/20; B04B 3/04; B04B 11/082; B04B 2001/2083
USPC ..... 494/27, 37, 53; 210/380.1, 380.3
See application file for complete search history.

(56) References Cited

U.S. PATENT DOCUMENTS

| | | | | | |
|---|---|---|---|---|---|
| 4,303,192 | A | * | 12/1981 | Katsume | 494/9 |
| 5,156,686 | A | * | 10/1992 | Van Slyke | 134/26 |
| 5,643,169 | A | * | 7/1997 | Leung et al. | 494/53 |
| 5,948,271 | A | * | 9/1999 | Wardwell et al. | 210/739 |
| 6,019,888 | A | * | 2/2000 | Mishra et al. | 208/341 |
| 6,605,029 | B1 | * | 8/2003 | Koch et al. | 494/53 |

* cited by examiner

*Primary Examiner* — Charles Cooley
*Assistant Examiner* — Marc C Howell
(74) *Attorney, Agent, or Firm* — James L. Sonntag

(57) ABSTRACT

A system for treating tar sand involving a centrifuge where under centrifugal force solvent treated tar sand and water form a three layer system of wet sand, water, and petroleum, where solvent solubilized hydrocarbons are stripped from the wet sand layer, passed through the water, and into the petroleum layer. The hydrocarbons are skimmed from the hydrocarbon layer and recovered.

15 Claims, 2 Drawing Sheets

CONTINUOUS LOADING AND UNLOADING CENTRIFUGE

REFERENCE TO RELATED APPLICATIONS

This application is a divisional application from U.S. patent application Ser. No. 11/946,043 now U.S. Pat. No. 7,985,171, filed Nov. 27, 2007, which claims priority from U.S. Provisional Patent Application 60/867,354, filed 27 Nov. 2006, which applications are hereby incorporated by reference.

BACKGROUND

Tar sands, also referred to as bituminous sands, represent a large portion of the unexploited reserve of hydrocarbon resources. A problem that has impeded their develment is the lack of economical methods for separating the hydrocarbon or petroleum portion from the "sand", the inert mineral portion.

SUMMARY

Described is a system for processing tar sands to separate hydrocarbons associated with mineral portions or sand of a tar sand. The tar sand is treated with a solvent (such as a petroleum fraction) to solubilize the hydrocarbons associated with the sand. The treated tar sand is then continuously introduced into a spinning centrifuge to subject the tar sand to centrifugal force, which increases the force to strip the solubilized hydrocarbon from the sand. Water is present in the centrifuge so that petroleum from the tar sand (including the hydrocarbon originally in the sand and the solvent), the water, and solid portions of the tar sand (the "sand" or mineral portion) form a three layered system, a solids layer, a water layer, and a petroleum layer.

Petroleum from the petroleum layer is continuously removed or skimmed from the petroleum layer to form a hydrocarbon product. Sand is also continuously removed by conveying it against the centrifugal force through and out of the water layer. Where the sand is removed, petroleum is blocked or excluded to prevent the petroleum from becoming reassociated with the sand. By further continuously conveying the sand under centrifugal force, the sand is further dewatered, to produce a damp sand for disposal, such as by depositing it into previously mined out spaces.

An exemplary apparatus comprises a cylindrical outer shell and a perforated cylindrical inner shell within the outer shell with a space between the inner and outer shell. Attached to the inner shell within the space are one or more auger flights. Tar sand that has been treated with solvent is introduced through a feed inlet into the outer shell. A drive system spins the outer shell and the inner shell about a spin axis to produce a centrifugal force that directs tar sand to an inside wall of the outer shell. On this inside wall is formed a three-layer system with a solids layer adjacent the inside wall. This layer includes sand, water, and any hydrocarbons and solvent not yet stripped from the sand. In addition, there is an overlying petroleum layer, which includes solvent and hydrocarbon stripped from the sand. Thirdly, there is an intermediate layer of water between the solids layer and the petroleum layer. The water volume is maintained and regulated such that the perforated inner shell is within the water layer.

During operation hydrocarbon that has been solubilized by the solvent is stripped from the sand and travels by buoyancy through the water layer, through the perforated inner shell, and to the overlying petroleum layer. A skimmer system is used to remove petroleum from the petroleum layer and convey it to the outside of the outer shell.

The drive system is configured to spin or drive the outer shell and the inner shell at different rates. This is so that the auger flights, which are suitably constructed, convey the sand in the solids layer toward the bottom of the outer shell, where it can be removed through a sand outlet.

The system for removal may comprise a lower conical section or extension of the outer shell, with the inner shell and the auger flights extended into the conical section. The construction is such that sand is conveyed by the auger flights into the conical section and toward the spin axis, such that the sand is conveyed through and out of the water layer, and is centrifugally dewatered as it is conveyed toward the spin axis. The conical section is extended sufficiently such that after the sand leaves the water, it is subjected further to centrifugal force to dewater the sand before it is removed from the apparatus. The portion of the inner shell extending into the conical section of the outer shell is not perforated in order to block petroleum from the petroleum layer from contacting the sand being conveyed out of the water layer.

Optionally, the apparatus has a spinning paddle disposed near the feed inlet to impart a stripping action to the solvent treated tar sand feed, and to convey the feed toward the inside wall of the outer shell.

DETAILED DESCRIPTION

Figure 1:
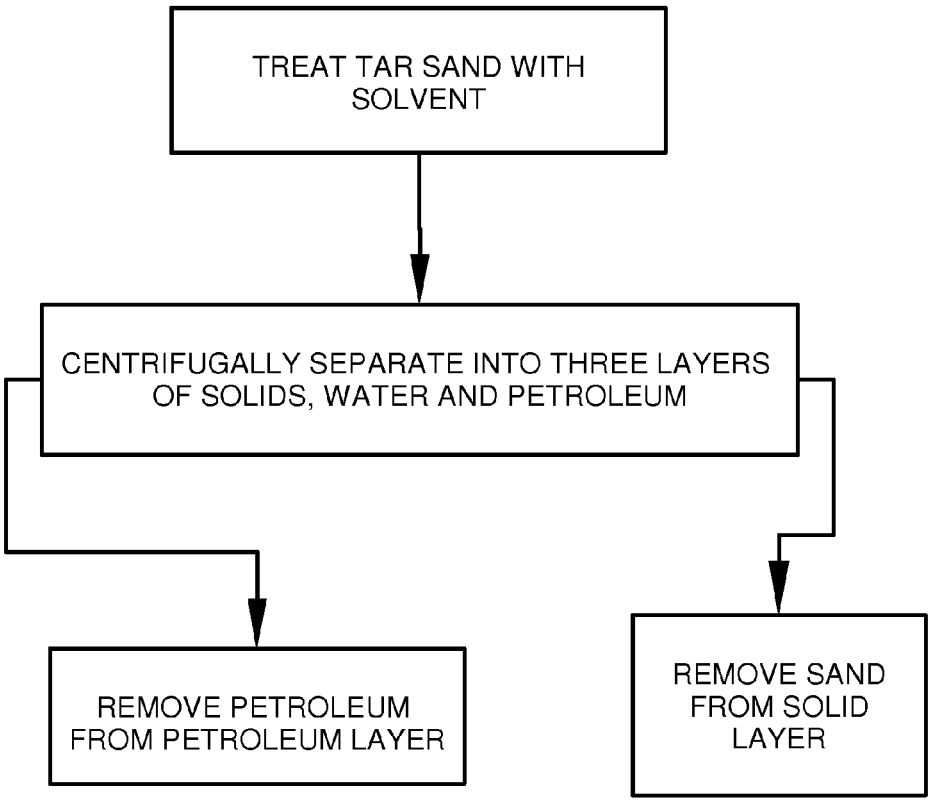
FIG. 1 is a flow sheet illustrating a process for separating the hydrocarbon portion from the mineral portion of tar sand.

Reference is made to FIG. 1, which is a flow sheet illustrating a method for processing tar sand to separate hydrocarbon portions from mineral portions. Tar sand is treated with solvent to solubilize the hydrocarbon portions, and continuously introduced to centrifugal force in the presence of water sufficient to form a layered system comprising a solids layer of sand from mineral portions, a layer of water, and a layer of petroleum of solvent and hydrocarbons from petroleum portions. Petroleum from the petroleum layer and sand are continuously removed to respectively form a hydrocarbon product stream, and a mineral tail stream.

EXAMPLE

Figure 2:
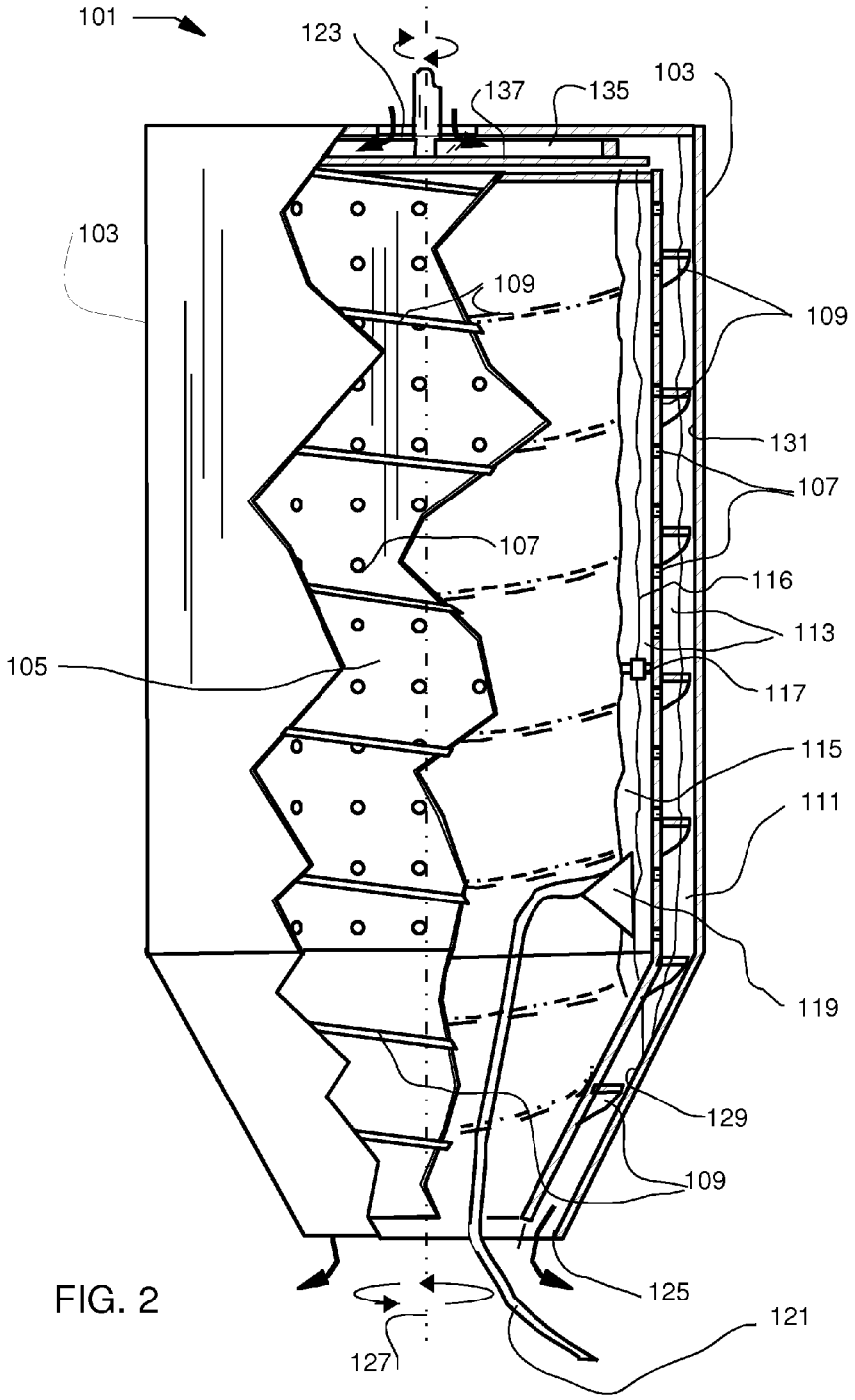
FIG. 2 is a schematic diagram illustrating an example of an apparatus for separating the hydrocarbon portion from the mineral portion of tar sand.

Reference is made to FIG. 2, which illustrates an example of a method and apparatus for processing tar sand. The centrifuge or separator 101 comprises an outer shell 103 and an inner shell 105. Attached to the inner shell is a helical auger flight or flights 109. The inner and outer shells 103, 105 are spun or rotated on the same axis 127. The spinning rates of the outer and inner shells are synchronized and are at different rates of rotation.

Tar sand that has been cut with a suitable solvent to solubilize the hydrocarbons is introduced into inlet 123. The solvent may be any suitable solvent, such as kerosene or other petroleum extract. By means of the centrifugal action of the spinning outer shell 103 the tar sand is conveyed to the inside wall 131 of the outer shell 103. The rates of rotation of the outer and inner shells 103, 105 are different and synchronized, and the construction of the flight 109 are such that the tar sand is conveyed by the flight down the inside wall 131 of the outer shell 103. Any suitable combination of spin rates and flight construction is contemplated, as for example, having the outer shell spin slightly faster, as long as the sand conveying action of the auger flight is achieved, and sufficient centrifugal force is provided. There may be one flight or multiple flights. The synchronization of the inner and outer shells can be by any suitable system (not shown), such as, for example, by use of any of synchronized electrical motors, hydraulic motors, planetary gears, chain drives, and the like.

The centrifugal force induced by the spinning shells forces any solids and liquids against the inside wall 131 of the outer shell 103. The solids form a solids layer 111 against the inside wall 131, which includes tar sand minerals or sand from which petroleum fraction or tar and solvent is extracted. The liquids include water and extracted petroleum fraction and solvent. Water is present in the outer shell, so that a water layer is formed over the sand, which is conveyed through the outer shell within a water phase.

As the tar sand is conveyed down the inside wall, under influence of the centrifugal force the solubilized tar strips from the sand and forms an oil or petroleum layer 115 upon the surface of the water. The inner shell is perforated with holes 107 to allow removed hydrocarbons with solvent to "rise" against the centrifugal force by means of buoyancy inward toward the center or spin axis of the drum through the water to a petroleum layer 115, which is over a water layer 113. The water layer 113 is between the solids layer 111 and the petroleum layer 115. The amount of water is such that the inner shell is within the water layer 113 so that the water/petroleum interface 116 is within the inside of the inner shell. Accordingly, the petroleum layer 115 is completely within the inner shell and can be effectively skimmed from the surface.

Water is introduced by any suitable means, normally with the tar sand feed. The amount of water is maintained essentially constant to maintain the proper location of the water/petroleum interface 116. The volume can be regulated by any suitable means, such as any combination of floats, sensors, valves and make-up water lines to add water to the tar sand feedstock. In the figure is shown a sensor 117. Water removal is continuous and in the amount required to make a damp sand tailing, which is the only "waste" water from the system.

Stripped hydrocarbons and solvent are skimmed or removed from the petroleum layer by any suitable system, such as an oil skimmer or scoop 119 with a petroleum outlet 121 to carry the petroleum from the interior of the shells.

As the sand approaches the lower end of the cylinder it becomes stripped of petroleum and solvent. The stripped sand is dewatered in a conical section of the outer shell at its lower end. The stripped sand is conveyed along a conical section 129 of the inside wall 131 of the outer shell 103. The conical section wall extends inward toward the spin axis 127. The inner shell 105 and auger flight 109 are constructed to extend into the conical section and match the conical construction of the outer shell 103 so as to convey sand inwardly along the inner wall 131 of the conical section 129 of the outer shell 103. The effect is to convey the sand against the centrifugal force and bring it out of the water layer.

In the conical section, the inner shell 105 is not perforated so that hydrocarbons and solvent from the petroleum layer are kept within the inner shell and from the sand as it is removed from the water. The sand is thus removed from the water in the space between the inner and outer shells and is thereby dewatered. The sand is further dewatered and dried by the centrifugal force as it continues along the conical inside wall, until it is eventually passed to outside the outer shell, though an outlet 125.

Optionally, a spinning paddle 135 is placed at the inlet 123. As the tar sand is introduced into the inlet it hits the paddle, and is forcibly directed toward the inside wall. The agitation is designed to increase the stripping of the solubilized tar from the sand. A disk is placed under the paddle to prevent tar sand from falling through the shell and direct the tar sand to the upper end of the inside wall. The spinning of the paddle need not be synchronized with the spinning of the shells and is preferably rotated in the opposite direction to increase the force for stripping of hydrocarbon from the sand. The axis of spin for the paddle is preferably the same as (or near to and parallel to) the axis of spin for the inner and outer shells. However, any suitable configuration is contemplated that functions to increase the stripping action and direct the tar-sand feed toward the top of the inside wall of the outer shell.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A method separating hydrocarbon portions from mineral portions of a tar sand comprising:

treating the tar sand with a solvent to solubilize hydrocarbon portions;

continuously introducing the treated tar sand to centrifugal force in a centrifuge in the presence of water sufficient to form a layered system comprising a solids layer comprising the mineral portions in the form of tar sand depleted of the solubilized hydrocarbon portions, a layer of water, and a layer of petroleum substances comprising the solvent and the solubilized hydrocarbon portions;

continuously maintaining an amount of water in the layer of water to maintain within the layer of water a perforated barrier member of the centrifuge in the layered system between the solids layer and the layer of petroleum substances that allows solubilized hydrocarbon portions to be conveyed by the centrifugal force from the solids layer to the layer of petroleum substances;

continuously removing the sand from the solids layer in the layered system;

continuously removing petroleum substances from the petroleum layer in the layered system.

2. The method of claim 1 wherein the sand is removed by conveying the sand against the centrifugal force through and out of the water layer.

3. The method of claim 2 wherein after the sand is conveyed out of the water layer the sand is centrifugally dewatered by the centrifugal force.

4. The method of claim 2 wherein the conveying of the sand against the centrifugal force by auger flights in a conical section.

5. The method of claim 2 wherein petroleum of the petroleum layer is blocked the sand being conveyed out of the water layer.

6. The method of claim 5 wherein the petroleum of the petroleum layer that is blocked from the sand being conveyed out of the water layer by a nonperforated barrier.

7. The method of claim 2 wherein the removed sand is further dewatered by continuously subjecting the sand to centrifugal force after it is conveyed out of the water layer.

8. A method separating hydrocarbon portions from mineral portions of a tar sand comprising:

treating the tar sand with a solvent to solubilize hydrocarbon portions;

continuously introducing the treated sand to centrifugal force in the presence of water sufficient to form a layered system comprising a solids layer comprising the mineral portions in the form of sand depleted of the hydrocarbon portions, a layer of water, and a layer of petroleum substances comprising the solvent and the hydrocarbon portions;

continuously removing the sand from the solids layer in the layered system;

continuously removing petroleum substances from the petroleum layer in the layered system, the continuously introducing the treated sand to centrifugal force is in an apparatus comprising a (1) cylindrical outer shell, (2) perforated cylindrical inner shell within the outer shell with a space between the inner and outer shell, (3) one or more auger flights attached to the inner shell within the space (4) feed inlet for introducing tar sand feed treated with solvent into the outer shell, (5) a drive system for spinning the outer shell and the inner shell about a spin axis, such that the centrifugal force directs introduced tar sand to an inside wall of the outer shell and form on the inside wall a three layer system with a solids layer adjacent the inside wall including sand, an overlying petroleum layer including solvent and petroleum stripped from the sand, and an intermediate water layer comprising water between the solids layer and the petroleum layer;

the presence of water is maintained sufficient by maintaining water volume such that the perforated inner shell is within the water layer, such that as solubilized petroleum is stripped from the sand in the solids layer, it travels by buoyancy through the water layer, through the perforated inner shell, and to the petroleum layer;

the continuously petroleum substances from the petroleum layer in the layered system is accomplished by removing petroleum from the petroleum layer to outside of the outer shell, the outer shell and the inner shell driven at different rates and the auger flights so constructed such that the flights convey the sand in the solids layer toward the bottom of the outer shell and through an outlet to outside of the outer shell.

9. The method of claim 8 wherein the sand is conveyed through and out of the water layer, and is centrifugally dewatered as it is conveyed toward the spin axis.

10. The method of claim 9 wherein the conveying of the sand out and through the water layer is by means of a lower conical section of the outer shell, with the inner shell and the auger flights extended into the conical section and constructed such that the sand is conveyed by the auger flights into the conical section and toward the spin axis.

11. The method of claim 8 wherein petroleum from the petroleum layer is blocked from sand being conveyed out of the water layer.

12. The method of claim 11 wherein petroleum is block by the portion of the inner shell extending into the conical section of the outer shell, which is not perforated.

13. The method of claim 8 wherein a feed is subjected to a mechanical stripping action is imparted to the solvent treated tar sand.

14. The method of claim 13 wherein the stripping action is by a spinning paddle disposed near the feed inlet.

15. The method of claim 1 wherein the continuously maintaining an amount of water comprises adding water to the treated tar sand.

* * * * *